US007393071B2

(12) United States Patent
Pan et al.

(10) Patent No.: US 7,393,071 B2
(45) **Date of Patent: *Jul. 1, 2008**

(54) INK LEVEL AND NEGATIVE PRESSURE CONTROL IN AN INK JET PRINTER

(75) Inventors: Yichuan Pan, San Diego, CA (US); Richard A. Murray, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 94 days.

This patent is subject to a terminal disclaimer.

(21) Appl. No.: 11/091,994

(22) Filed: Mar. 29, 2005

(65) Prior Publication Data

US 2005/0168504 A1 Aug. 4, 2005

Related U.S. Application Data

(63) Continuation of application No. 10/113,700, filed on Apr. 1, 2002, now Pat. No. 6,908,179.

(60) Provisional application No. 60/281,555, filed on Apr. 4, 2001.

(51) Int. Cl.
*B41J 2/195* (2006.01)
*B41J 2/175* (2006.01)

(52) U.S. Cl. ..... 347/7; 347/86

(58) Field of Classification Search ..... 347/7, 347/85–87

See application file for complete search history.

(56) References Cited

U.S. PATENT DOCUMENTS

| | | | | |
|---|---|---|---|---|
| 4,551,734 | A | 11/1985 | Causley et al. | |
| 5,136,309 | A | 8/1992 | Iida et al. | |
| 5,289,211 | A | 2/1994 | Morandotti et al. | |
| 5,686,947 | A | 11/1997 | Murray et al. | |
| 5,757,390 | A | 5/1998 | Gragg et al. | |
| 5,764,259 | A * | 6/1998 | Nakajima | 347/86 |
| 5,818,484 | A | 10/1998 | Lee et al. | |
| 6,315,402 | B1 | 11/2001 | Kawase | |
| 6,736,497 | B2 * | 5/2004 | Jung | 347/86 |

* cited by examiner

*Primary Examiner*—An H Do
(74) *Attorney, Agent, or Firm*—Mark G. Bocchetti

(57) ABSTRACT

An ink jet printer having an expandable ink container biased to expand and configured to receive refill ink and an ink reservoir to provide refill ink to the expandable ink container. The printer also has an electronic volume detector to detect a refill value and a full value of the volume of the expandable ink container. The flow of refill ink begins when the volume of the expandable ink container decreases to the refill value and ceases when the volume of the expandable ink container increases to the full value.

19 Claims, 9 Drawing Sheets

INK LEVEL AND NEGATIVE PRESSURE CONTROL IN AN INK JET PRINTER

CROSS REFERENCE TO RELATED APPLICATIONS

This is a continuation application of U.S. Ser. No. 10/113,700, now U.S. Pat. No. 6,908,179, filed Apr. 1, 2002, entitled INK LEVEL AND NEGATIVE PRESSURE CONTROL IN AN INK JET PRINTER, which is a 111 A application of and claims priority from U.S. Provisional Application No. 60/281,555, filed Apr. 4, 2001, also entitled INK LEVEL AND NEGATIVE PRESSURE CONTROL IN AN INK JET PRINTER.

FIELD OF THE INVENTION

The invention relates generally to ink jet printer cartridges and specifically to structures and methods for maintaining correct pressure and refilling the ink in an ink jet printer cartridge.

BACKGROUND OF THE INVENTION

Replaceable printer cartridges tend to be relatively expensive due largely to the fact that they have a fixed ink volume. This ink volume must be relatively small because the cartridge is part of the rapidly moving print carriage, and thus, ink cartridges with larger volumes would require larger and more costly mechanisms for such motion. Larger ink volumes would also lead to more breakdowns of the system due to the increased stress on the components that must support and move the larger ink volume.

To extend the useful life of disposable print cartridges, large-volume and stationary ink reservoirs have been mounted to ink jet printers to refill the ink contained in the print cartridges installed on the moving carriages. But these systems must contend with certain design obstacles. For instance, the pressure of the ink in the cartridge should generally be lower than atmospheric pressure, or relatively negative, in order to prevent ink from running out of the nozzle plate. This means that the cartridge must not only contain the ink, but it must also include a structure or component that lowers the pressure of the ink stored in the cartridge, even when refill ink is being supplied to the cartridge. Also, the rapid movement of the print head can cause pressure fluctuations in the print cartridge. Finally, as previously mentioned the weight of the printer cartridge should be minimized to reduce both the cost and frequency of repairs of the print head support and movement mechanisms.

One attempt to address these issues comprises a system that directly connects the print cartridge to a large-volume reservoir through an ink supply line. Another concept uses a modular approach to achieve the same goal, allowing the replacement of the cartridge or the large-volume ink reservoir independently of one another. These two approaches have disadvantages, however. For example, the hydraulic pressure at the nozzle plate on the print cartridge is affected by the height of the large-volume reservoir, a pressure drop caused by the viscous ink flow in the ink supply line, and pressure surges caused by the carriage acceleration during printing. As mentioned before, these unfavorable pressure effects can adversely impact the performance of the nozzles, hindering printer performance and print quality. In general, the ink droplets expelled from nozzles on the print head become smaller when the pressure inside the printer cartridge becomes more negative. During printing, the pressure variation related to the reservoir height, the viscous flow in the ink supply line and the pressure surges caused by carriage acceleration, therefore, cause print quality to degrade. When the pressure inside the printer cartridge becomes too negative, nozzle starvation can happen, resulting in a failure of the nozzles to stop expelling ink. Other disadvantages of these systems include difficult cartridge replacement procedures that can be very messy.

Other proposed solutions to the problem allow the printer cartridge to regulate its own pressure to minimize the effects of pressure variations from the large-volume reservoir, the pressure loss in the supply line and the surges from printer carriage acceleration. One such system adopts a "take a gulp" method for refilling the printer cartridge. When an ink refill is required, the printer carriage stops at a refill station at one end of the carriage travel and is refilled from the large-volume reservoir. Another approach involves installation of pressure sensing and control devices in the replaceable print cartridge. This system allows on-the-fly ink refill during printing by using a valve, bias spring, and variable volume containment chamber in the cartridge. The valve is adapted to regulate ink flow from a remote reservoir. The ink refill is mechanically controlled by the valve, which is mechanically linked to the containment chamber. When the containment chamber volume decreases to a certain value, the valve is opened to commence the flow of refill ink and to increase the volume of the containment chamber until the volume increases to a certain value at which point the valve closes securing the flow of refill ink. When the print cartridge needs to be replaced, the whole pressure regulation system is disposed of.

Another alternative adopts a different approach; this approach puts the entire pressure regulation system on the printer base and not on the carriage.

In this way, the pressure regulation system is not disposed of when the cartridge is replaced, and the ink refill decision is made by the more powerful printer, which can utilize more information, such as from the large-volume ink reservoir as well as print conditions and history. However, the pressure sensor is not in the print cartridge so the pressure that is regulated is not the cartridge pressure but rather is the refill line pressure, which can be substantially different. All of these approaches attempt to refill the ink in the print cartridge while maintaining the appropriate pressure, at an affordable cost while offering the best performance. These proposed solutions fail to effectively refill the ink in the print cartridge while maintaining the pressure in that cartridge in the most effective manner. What is needed, is a system that utilizes the power of the printer controller to control the refill cycles, to most effectively regulate the refill process. The system should also maintain the correct pressure in the print cartridge while storing the refill ink volume separate from the print head. The system should also limit the amount of components that must be discarded and replaced when the print cartridge is replaced.

SUMMARY OF THE INVENTION

The systems and methods of ink level and pressure control in an inkjet printer have several features, no single one of which is solely responsible for its desirable attributes. Without limiting the scope as expressed by the claims that follow, its more prominent features will now be discussed briefly. After considering this discussion, and particularly after reading the section entitled "Detailed Description of the Preferred Embodiments" one will understand how the features of the system and methods provide several advantages over traditional printer systems and methods.

In one aspect, the invention relates to a method of refilling an expandable ink container from an ink reservoir and maintaining a correct pressure of the expandable ink container for an inkjet printer. This method can be accomplished by applying an expanding force to the expandable ink container, applying a collapsing force to an ink reservoir, and transferring ink from the reservoir to the expandable ink container, wherein the transfer of ink is controlled electronically and begins when the volume of ink in the expandable ink container decreases to a refill value and ceases when the volume of ink in the expandable ink container increases to a full value, Alternatively, the ink in the reservoir may be pressurized by a pump, for example, for transfer to the expandable ink container.

In another aspect, an ink jet printer is described comprising an expandable ink container biased to expand and configured to receive refill ink from an ink reservoir. The ink reservoir contains ink under relatively higher pressure than the expandable ink container and is configured to provide refill ink to the expandable ink container when the electronically measured volume of the expandable ink container decreases to a refill value. The refill process ceases when the electronically determined volume of the expandable ink container increases to a full value.

In yet another aspect, an ink jet printer is described having a print cartridge housing an ink container, and a method is described for refilling the ink container and maintaining a preferred pressure range in the ink container. This is accomplished by applying a force tending to expand the ink container and supplying refill ink to the print cartridge from a refill ink reservoir. In this process, the supply of refill ink is commenced when the volume of ink in the print cartridge, which is electronically sensed, is low and is terminated when the volume of ink in the print cartridge is high.

DETAILED DESCRIPTION OF THE INVENTION

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

Figure 1:
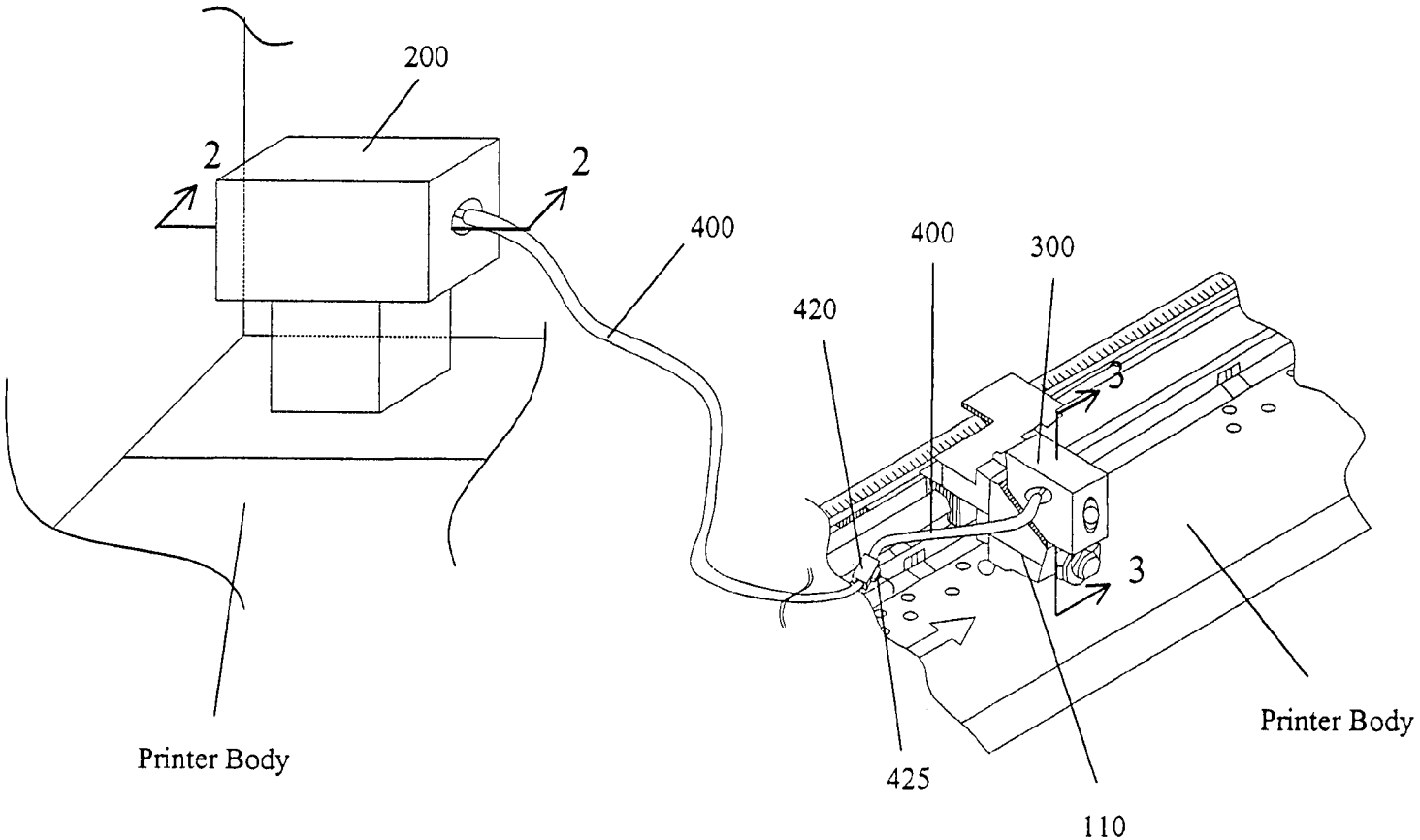
FIG. 1 is a perspective view of a first embodiment of a system for refilling the ink in a print cartridge on an ink jet printer.

Referring initially to FIG. 1, a perspective view of a first embodiment of a system 100 for refilling an ink jet printer is illustrated. The system 100 has an ink reservoir 200, a printer cartridge 300, and a supply line 400. The ink reservoir 200, mounted on part of the printer body can store a large volume of refill ink under a pressure relatively higher than that in the printer cartridge 300 to cause flow of refill ink from the ink reservoir 200 to the printer cartridge 300 when refill of ink is required. The supply line 400 connects the ink reservoir 200 to the printer cartridge 300, which is mounted on the rapidly moving printer carriage 110, to direct the flow of refill ink when the printer cartridge 300 ink level is low. The supply line 400 has a flow control valve 420 to control the flow of refill ink. A differential pressure exists across the flow control valve 420 between the relatively higher pressure of the ink in the ink reservoir 200 and the relatively lower pressure of the ink in the printer cartridge 300. When the flow control valve 420 opens, a flow of refill ink from the ink reservoir 200 to the printer cartridge 300 begins. A valve actuator 425 controls the position of the flow control valve 420. Alternatively, the ink reservoir 200 is not pressurized, but rather is open to atmospheric pressure and a pump (not shown in FIG. 1) is used to provide a flow of refill ink from the ink reservoir 200 to the printer cartridge 300.

The relatively higher pressure in the ink reservoir 200 can be achieved in many different ways. A simple method, for example, is to place the ink reservoir 200 at a higher position in the printer relative to the printer cartridge 300, resulting in a differential of hydraulic fluid height, or head, between the ink reservoir 200 and the printer cartridge 300. Another example is to use a pump to supply the required pressure to the ink reservoir 200. A unique way to establish the higher pressure in the ink reservoir 200 is shown in FIG. 2.

Figure 2:
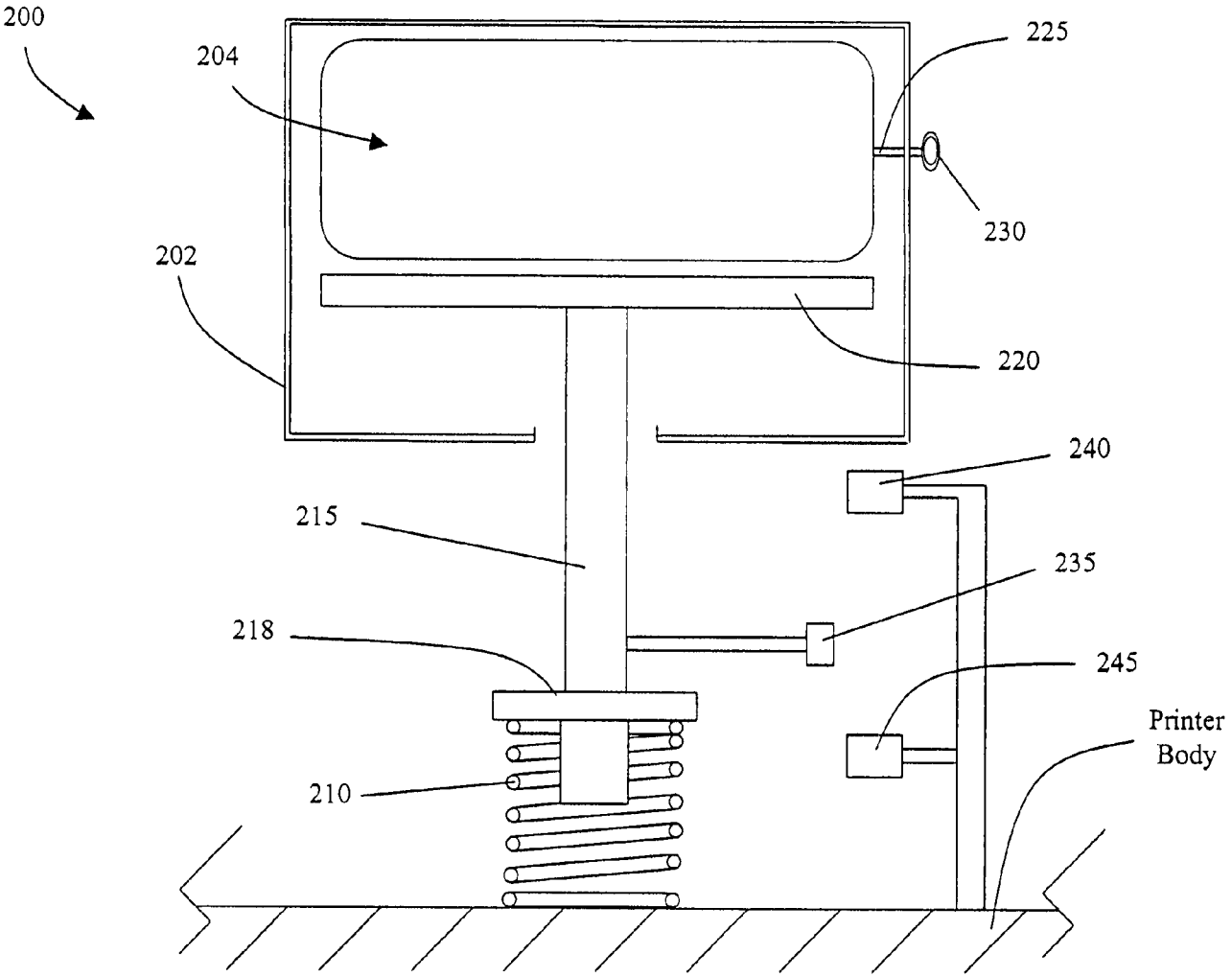
FIG. 2 is a cutaway side view, taken along line 2-2, of the ink reservoir of FIG. 1.

Referring to FIG. 2, a cutaway side view of an ink reservoir 200, it is appreciated that the ink reservoir 200 can advantageously be mounted on a fixed part of the printer body. This prevents pressure fluctuations that can occur if the ink reservoir 200 is mounted on a moving part of the printer, such as the printer carriage (item 110 in FIG. 1). In certain embodiments, the ink reservoir 200 has a housing 202 that encapsulates a collapsible ink container 204. Any structure that is capable of containing ink and is also capable of flexibly collapsing can be used as the collapsible ink container 204; for instance, it can be a bladder. In some embodiments, the housing 202 and the collapsible ink container 204 can be integral. For instance, a bellows may be utilized for both the housing 202 and the collapsible ink container 204, in which case the bellows would be capable of collapsing.

A force is biased to collapse the collapsible ink container 204. In certain embodiments, the force may be generated by a spring 210 that applies a force to the collapsible ink container 204 using a plate or platform. In the embodiment illustrated in FIG. 2, the force is applied to the collapsible ink container 204 through a piston 215 and a reservoir plate 220. As shown in FIG. 2, energy stored in the spring 210 is applied as a force to a spring platform 218 that forms a type of union between the spring 210 and the piston 215. The spring platform 218 transfers the force of the spring 210 to the piston 215, which may be in contact with or affixed to the reservoir plate 220 such that the force is also transferred to the reservoir plate 220. The reservoir plate 220 then applies the force to the collapsible ink container 204 tending to collapse it. This force results in an increased pressure of the ink inside of the collapsible ink container 204, which causes the flow of refill ink when required.

Figure 3:
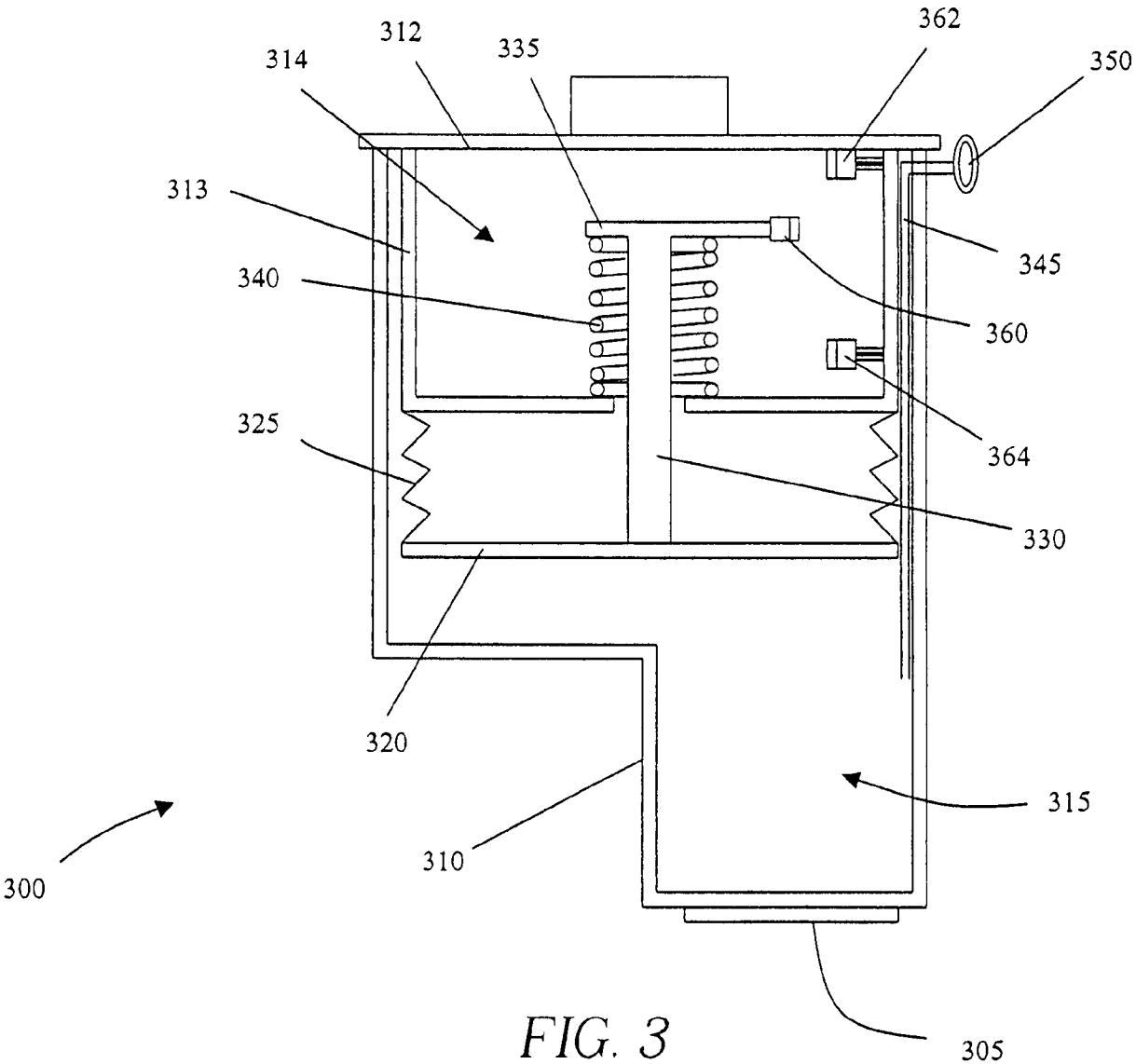
FIG. 3 is a cutaway side view, taken along line 3-3, of the print cartridge of FIG. 1.

The collapsible ink container 204 has a mechanism for transferring the refill ink out of the ink reservoir 200 and into a supply line (item 400 in FIGS. 1 and 4), when refill is required. As illustrated in FIG. 2, the collapsible ink container 204 has a reservoir tube 225 attached to it that is capable of transferring ink from inside the collapsible ink container 204 to the outside of the housing 202. A reservoir septum 230 forms a couple between the reservoir tube 225 and the supply line needle (described later as item 415 of FIG. 4) to connect the supply line (item 400 in FIGS. 1 and 4) to the ink reservoir 200. Alternatively, any connection fittings may be used between the supply line and the reservoir tube 225. Referring to FIGS. 1 and 3, and as described above, rather than using a collapsible ink container 204, in some embodiments the ink contained in the reservoir will be open to atmospheric pressure. U.S. Pat. No. 5,686,947 to Murray et al. ("Murray"), the disclosure of which is hereby incorporated for all that it discloses, describes a reservoir system that has a large volume ink reservoir open to atmospheric pressure. Such a system may be utilized as an alternative to the collapsible ink container 204, and flow energy, motive force on the liquid to cause the refill ink to flow from the reservoir to the printer cartridge 300, is added to the refill ink to overcome the previously discussed pressure surges from the movement of the supply line 400 and the viscous flow losses as the refill ink flows through the supply line 400 as well as the influence of any height difference between the reservoir 300 and the printer cartridge 200. As mentioned before, the flow energy may be added by the use of a pump (not shown), by locating the reservoir 200 higher in the printer than the print cartridge 300, or by any other means known in the art.

Referring again to FIG. 2, in some embodiments, it may be advantageous to determine the amount of ink left in the ink reservoir 200 and it may further be advantageous to develop electronic signals that represent the amount of ink in the ink reservoir 200. Some applications may only require a signal for a low level of ink in the ink reservoir 200, while other applications may require a high level indication as well. Yet other embodiments may require continuous indication of level, such as perhaps a continuum of ink level indication from high level to low level, similar to a fuel level gage in an automobile. These applications and characteristics will be determined by the users needs. Many different level sensing and indicating devices exist and can be used for this function. One example of such a system is illustrated in FIG. 2. In FIG. 2, the piston 215 has affixed to it a position indicator 235 that is attached at some reference level on the piston 215. In this embodiment, the position indicator 235 moves up and down along a linear path as the volume of ink in the collapsible ink container 204 changes. In this system, the position indicator 235 starts at a bottom endpoint when the collapsible ink container 204 is full and moves upward as ink is transferred out of the collapsible ink container 204 and the volume decreases. The position indicator 235 ends up at a high endpoint corresponding to an empty collapsible ink container 204.

There may be placed, proximate to the upper and lower position indicator 235 travel path endpoints, respectively, a low ink level detector 240 and a high ink level detector 245. These detectors 240, 245 are positioned to correspond to the empty and full volumes of the collapsible ink container 204, respectively. Thus, in this embodiment, when the collapsible ink container 204 is full, the piston 215 and the position indicator 235 will be at their lowest positions. At that point, the position indicator 235 will be positioned proximate to the high level detector 245, allowing the high level detector 245 to develop a signal to indicate the volume condition of the full ink reservoir 200 to the printer (not shown). Conversely, as the volume of the collapsible ink container 204 decreases to an empty value, the piston 215 and the position indicator 235 will be at their highest points of travel, in this embodiment. At this position, the position indicator 235 will be proximate to the low level detector 240, allowing the low level detector 240 to develop a signal to indicate the volume condition of the empty ink reservoir 200 to the printer (not shown).

There are many mechanisms known that can be used to detect and indicate a position of one device with respect to another, such as exists in FIG. 2, and any of these mechanisms may be employed. One example of such a mechanism is a light source and detectors. In this mechanism, the position indicator 235 is a light source such as an LED (light emitting diode) while the high and low level detectors 245, 240 are light sensors such as CCDs (charge couple devices) or photomultipliers. Another mechanism that can be used in an embodiment is one or more limit switches. To use limit switches, the high and low level detectors 245, 240 can each be a switch in a circuit that is closed by the presence of the position indicator 235. The position indicator 235 may indicate a position either electrically, mechanically, magnetically with light or otherwise. When the switch is closed, the circuit associated with that switch is completed and a signal is generated corresponding to the appropriate level in the collapsible ink container 204. The high and low level detectors 245, 240 can be any of these or other sensing elements depending on the needs of any particular application.

Figure 2A:
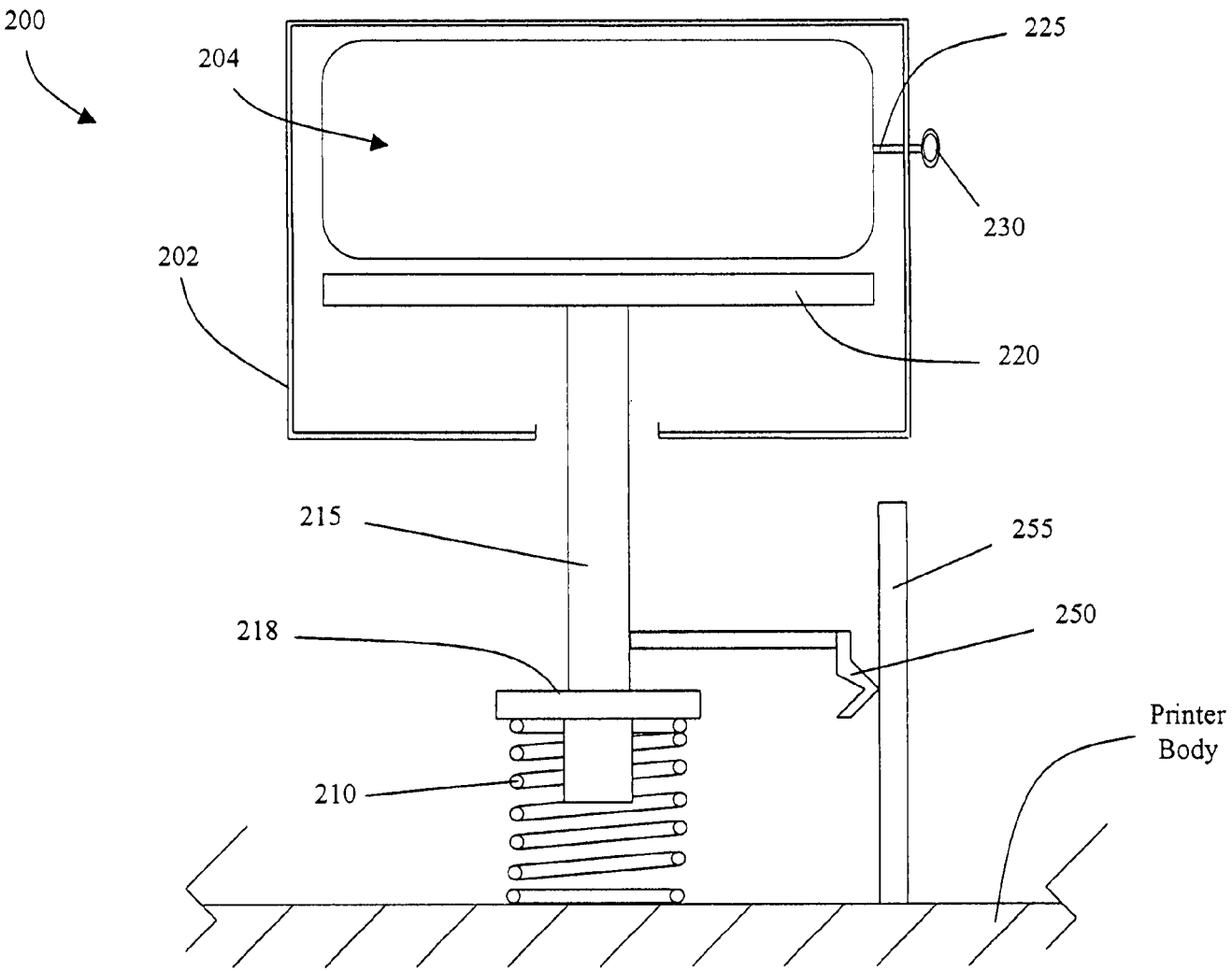
FIG. 2A is a cutaway side view, taken along line 2-2 of FIG. 1, illustrating an alternate embodiment of the ink reservoir of FIG. 1.

FIG. 2A illustrates another type of sensor that may be used to create a signal proportional to the level of ink in the reservoir 200 at multiple ink levels rather than just two. In this embodiment, a position indicator 250 is in electrical contact with a resistance strip 255. The position indicator 250 and the resistance strip 255 complete a circuit (not shown) having a resistance that is proportional to the amount of resistance strip 255 that exists in the circuit. As the position indicator moves up the strip, corresponding to the ink level in the reservoir decreasing, the position indicator 250 contacts the resistance strip 255 at a higher point. If the circuit is connected to the bottom of the resistance strip 255, more resistance strip 255 will be in the circuit and the resistance of the circuit will be higher. The resistance across the circuit can be measured and a correspondence between the level of ink remaining in the ink reservoir 200 and the resistance of the circuit can be developed. This means that the printer can sense the level of ink in the reservoir 200 at any level rather than just full or empty by detecting the resistance of the circuit.

In alternative embodiments, the position indicator 235 may be mounted to other components such as the reservoir plate 220, the spring plate 218 or the collapsible ink container 204 itself, if it is the sort that is integral with the reservoir housing 202. In these alternative embodiments, the high level and low level detectors 245, 240 may be located elsewhere as appropriate in order to correspond correctly to the full and empty volumes of the reservoir 200, respectively. Alternatively, the position indicator 250 and the resistance strip 255, as illustrated in FIG. 2A for continuous ink level sensing, can be integrated as part of the reservoir. The signals developed by the detectors that reflect the amount of ink remaining in the reservoir 200 are transferred via electronic leads (not shown) to a processor or microprocessor (not shown) for utilization in the control of the flow of refill ink. In embodiments not using a pressurized and enclosed reservoir 200, but rather one that is open to the atmosphere, other sensing means are required. In such instances, any of numerous means known to detect the level of liquid contained in a tank may be used. Such means may include, for example, the use of two electrodes at a certain level in the tank, wherein the electrodes utilize the ink in the tank to complete a circuit between them. In this embodiment, when the electrodes become uncovered as the fluid level decreases, the circuit is broken and a signal indicating this condition is passed on to the processor (not shown).

Another means of detecting the level of ink in the open tank is a light operated switch similar to that described above, where a light path between a light source and a light detector is disturbed by the presence of ink in the reservoir 200. When the ink is absent from the light path, a signal is developed indicating that the ink level is below the level defined by that detector. Multiple sets of light sources and detectors may be used to detect ink at any of multiple levels, or one source of light may be used in conjunction with multiple detectors. Alternatively, a continuum of ink levels may be detected using a buoyant position indicator and any of the detecting means described above. As mentioned before, these signals can be used to ensure that refilling the printer cartridge (item 300 of FIG. 1) with a supply of refill ink is not commenced when there is not enough ink present in the reservoir 200. It may be desirable to have a level indicating window (not shown) as illustrated in Murray, where the user may look at the reservoir 300 to see how much ink remains in it.

FIG. 3 is a cutaway side view of a printer cartridge 300 of one embodiment of the system illustrated in FIG. 1. In advantageous embodiments, the printer cartridge 300 has certain characteristics to ensure the printer produces the highest quality image possible. First, the pressure of the ink in the printer cartridge 300 is preferably below the pressure of the atmosphere in which the printer is operating. A nozzle plate 305 is attached to the printer cartridge 300. The nozzle plate 305 houses the nozzles that expel the droplets of ink onto the print medium (not shown) in the printing operation. The low ink pressure prevents the ink from inadvertently running out of the nozzle plate 305. The pressure in the printer cartridge 300 is preferably maintained in a range that is appropriate for a particular nozzle plate 305 and application, and may range from just below atmospheric to as many as 15 or 20 inches of water below atmospheric. To produce the highest image quality possible, this pressure range is preferred to be between 2 and 6 inches of water below atmospheric. If the pressure of the ink in the printer cartridge 300 is too far below atmospheric pressure, the nozzles may not be able to overcome the pressure difference, leading to incorrect operation of the nozzles and degraded image quality, or worse yet, to nozzle starvation or depriming.

Another characteristic of certain embodiments is that the printer cartridge 300 is configured to be refilled, thereby avoiding costly replacement of the printer cartridge 300 when it runs out of ink. The printer cartridge 300 contains electronics (not shown) necessary to operate the nozzles on the nozzle plate 305. These electronic components and the nozzle plate are discarded when the printer cartridge 300 is replaced and, therefore, the replacement of the printer cartridge 300 costs much more than just the ink that necessitates the replacement. To avoid the relatively high cost of replacement of the printer cartridge 300 when all that is needed is more ink for its continued operation, advantageous print cartridges 300 are configured to allow for refill of the ink they contain.

In the embodiment illustrated in FIG. 3, both of these characteristics can be achieved through incorporation of certain design features or their equivalents. The printer cartridge 300 of FIG. 3 comprises a nozzle plate 305 affixed to the operating end, or ink ejecting end, of a cartridge housing 310. The cartridge housing 310 forms a volume for holding the ink and internal components of the printer cartridge 300, as well as housing the nozzle plate 305 on its outer surface. The volume of the printer cartridge 300 is completed by a cap 312 that sits atop of the cartridge housing 310 and closes off the internal portion of the printer cartridge 300 from the external environment. The cap 312 may be designed to be replaceably attached, or it may be permanently affixed, to the cartridge housing 310 to form an integral housing component (items 310 and 312 together). In the embodiment illustrated in FIG. 3, the cap 312 has a lower portion 313 that extends below the top of the sides of the cartridge housing 310. This lower portion 313 forms a void space 314 between itself and the upper portion of the cap 312.

The ink storage along with the pressure controlling and ink level sensing components of the printer cartridge 300 are located inside the cartridge housing 310 in the embodiment illustrated in FIG. 3. These components include an expandable ink chamber 315, a cartridge plate 320, a bellows 325, a cartridge shaft 330, a spring platform 335, and a cartridge spring 340. The expandable ink chamber 315 is configured to store ink in the printer cartridge 300 and it is formed by the bottom of the cartridge plate 320, the outside of the bellows 325 connecting the lower portion of the cap 312 to the cartridge plate 320, the inner walls of the cartridge housing 310, and the upper portion of the cap 312. It is to be appreciated by examining the embodiment of a printer cartridge illustrated in FIG. 3 that the volume of the expandable ink chamber 315 may decrease as ink is drawn out of the cartridge by the nozzle plate 305 for printing, and the volume may expand upon refill operations. As refill ink is supplied to the expandable ink container 315, the bellows 325 contracts allowing the expandable ink chamber 315 to expand, as its ink volume increases. The bellows 325 is attached to the outside edges of the cartridge plate 320, which is generally a flat plate having a shape that corresponds to the inner edges of the cartridge housing 310, to form an air-tight seal between the cartridge plate 320 and the bellows 325. The bellows can be made of any flexible thin film, e.g., polyester, polyethylene, or composite film with different layers for functions such as flexibility, strength, or moisture resistance or imperviousness. The cartridge plate 320 and the bellows 325 act in conjunction with the cartridge housing 310 to encapsulate the expandable ink chamber 315. The cartridge shaft 330 is attached to the top of the cartridge plate 320 and is generally a longitudinal rod that extends from the top of the cartridge plate 320 into the void space 314 formed between the upper and lower portions of the cap 312, 313. At the end of the shaft 330, located opposite the cartridge plate 320, is the spring platform 335. The spring platform 335 is generally a flat annular flange located on the end of the shaft 330 and is capable of applying a tension to the shaft 330.

The cartridge spring 340 surrounds the shaft 330 and is located between the lower portion of the cap 313 and the spring platform 335. The cartridge spring 340 is seated on the bottom surface of the spring platform 335 such that it tends to apply a force upward on the spring platform 335. This force is then transferred to the shaft 330, and then from the shaft 330 to the cartridge plate 320. The cartridge plate 320 is encouraged by the spring force to move upward, collapsing the bellows 325, and tending to expand the expandable ink chamber 315. This force applied to the cartridge plate 320, that tends to expand the expandable ink chamber 315, controls the pressure of the expandable ink chamber 315. The tendency of the expandable ink chamber 315 to expand under the force of the cartridge spring 340 creates a pressure difference across the nozzle plate 305, which can prevent ink from inadvertently flowing out of the nozzles while not printing, or during shipping. In this manner, the embodiment of the printer cartridge 300 illustrated in FIG. 3 regulates the pressure of the expandable ink chamber 315 with the force of the cartridge spring 340. Therefore, the spring force of the cartridge spring 340 is what determines the pressure of the ink in the expandable ink chamber 315 located in the printer cartridge 300 illustrated in this embodiment.

Figure 3A:
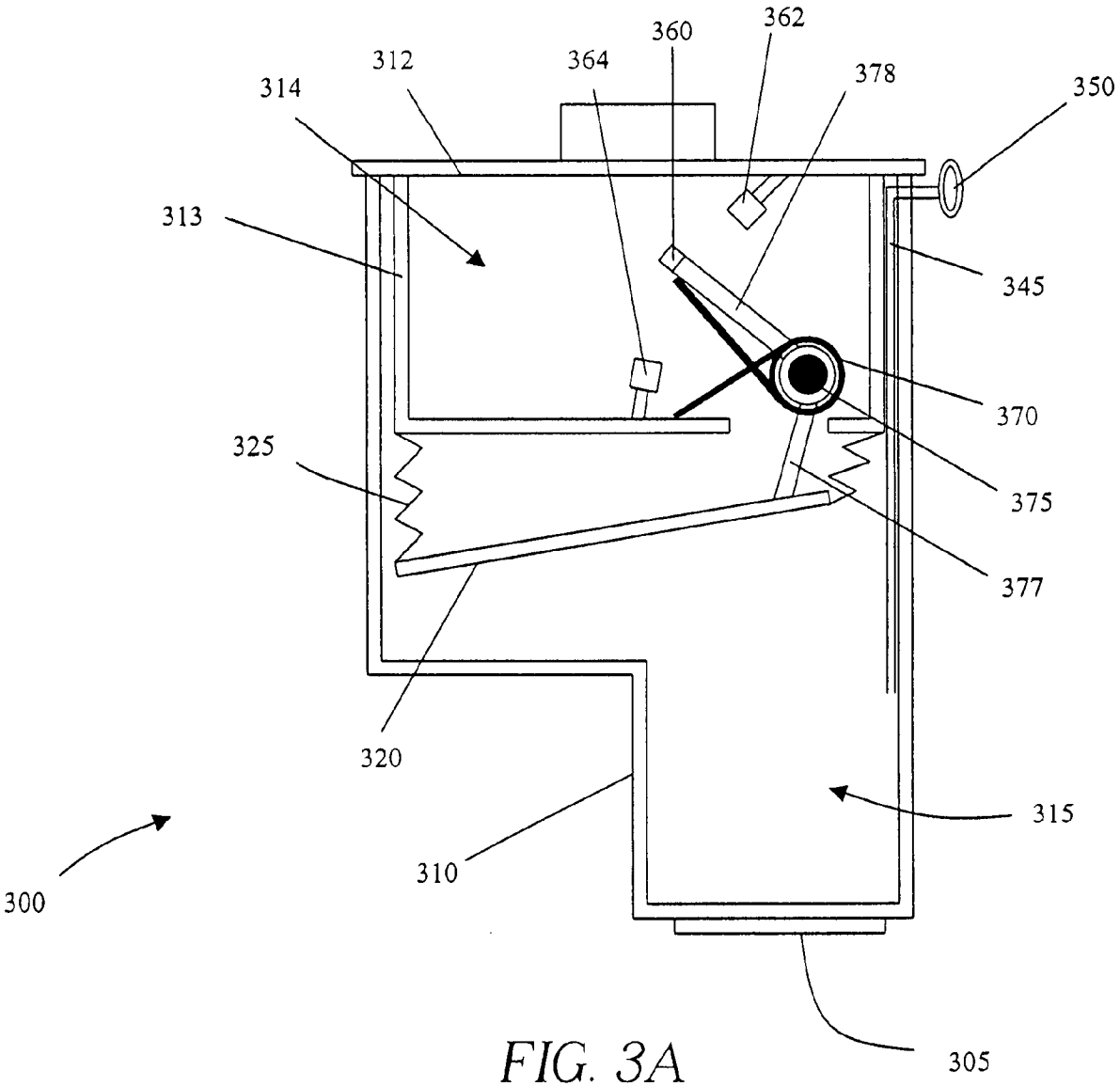
FIG. 3A is a cutaway side view, taken along line 3-3 of FIG. 1, illustrating an alternate embodiment of the print cartridge of FIG. 1.

Any other configuration of spring and platform locations can be utilized to meet this same objective of regulating the pressure of the ink in the printer cartridge 300 with a spring. Another embodiment of such a system is illustrated in FIG. 3A. FIG. 3A illustrates a printer cartridge 300 that utilizes a torsion spring 370 to maintain the negative pressure on the ink contained in the printer cartridge 300. Instead of the cartridge plate 320 moving straight up and down as the amount of ink in the printer cartridge 300 changes, the cartridge plate 320 is mounted on a pivot 375 near one edge of the cartridge plate 320 and rotates about that pivot 375. The pivot 375 is fixed to a portion of the printer cartridge 300 structure such as the cap 313. A plate leg 377 extends from the cartridge plate 320 and forms a pin joint about the pivot 375. An indicating leg 378 extends from the pivot 375 and is rigidly attached to the pin joint formed by the plate leg 377. The indicating leg 378 has an ink level indicator 360 attached to it that rotates about an arc as the cartridge plate 320 rotates about the pivot 375. The position of the ink level indicator 360 at each point along its path corresponds to an amount of ink remaining in the printer cartridge 300. A description of the printer cartridge ink level sensing method and mechanism is provided below. The torsion spring 370 is mounted coaxially about the pivot 375 and has two ends that extend out from the coil to apply force. One end applies a force against the indicator leg 378 and the other end applies a force against a fixed portion of the printer cartridge housing, such as the lower portion of the cap 313. By applying a force to the indicator leg 378 and a fixed portion of the printer cartridge 300, the torsion spring 370 tends to cause the cartridge plate 320 to rotate about the pivot 375, thereby tending to expand the volume of the ink chamber 315 and reduce the pressure of that ink.

Also illustrated in FIG. 3 is a means for allowing the flow of refill ink into the printer cartridge 300. A cartridge tube 345 is included in certain embodiments to allow ink to flow through the cartridge housing 310 and into the expandable ink chamber 315. In one embodiment, the cartridge tube 345 is a generally tubular shape that protrudes through either the cartridge housing 310, as illustrated in FIG. 3, through a portion of the cap 312, or through another portion of the printer cartridge 300. The cartridge tube 345 extends into the expandable ink chamber 315 at one end thereof. The other end, which extends out of the printer cartridge 300, has a cartridge septum 350 mounted upon it. The cartridge septum 350 is of the type common in the art for receiving a needle that is inserted into it. Alternatively, the septum and needle connection can be replaced by any type of connection fittings. The cartridge tube 345 and the cartridge septum 350 therefore create a flowpath for refill ink to pass through the exterior of the printer cartridge 300 and into the expandable ink chamber 315.

As is illustrated in FIGS. 3 and 3A, embodiments may have sensing means for detecting, and developing signals corresponding to, the amount of ink remaining in the expandable ink chamber 315. In particular, the sensing means of the embodiment of the printer cartridge 300 illustrated in FIG. 3 is located in the void space 314 of the cap 312, but it may be located elsewhere on or in the printer cartridge 300 or on the indicator leg 378 of the embodiments illustrated in FIGS. 3A, 3B. The sensing means may comprise a position-indicating device and one or more position detecting devices. For example, the embodiments illustrated in FIGS. 3, 3A and 3B includes an ink volume indicator 360 and two ink volume detectors, a high ink volume detector 362 and a low ink volume detector 364. Similar to the indicator and detectors discussed above with respect to the embodiment of FIG. 2, the ink volume indicator 360 can be any device that signals its presence to the ink volume detectors 362, 364. As above, the ink volume indicator 360 may be an LED or a magnet or any other indicating means commonly used for position detection to develop signals in the ink volume detectors 362, 364 that correspond to the volume of ink in the expandable ink chamber 315.

In FIG. 3, the ink volume indicator 360 is mounted to the spring platform 335. In other embodiments it may be mounted to any other component whose position corresponds to the volume of ink in the expandable ink chamber 315, such as the indicator leg 378 of FIGS. 3A and 3B. Other components might include the cartridge plate 320, the shaft 330, the cartridge spring 340 or the bellows 325. The ink volume indicator 360 moves up and down with the bottom travel point corresponding to a low level volume of ink in the expandable ink chamber 315 and the top travel point corresponding to a high level volume of ink in the expandable ink chamber 315. At one or both of the top and bottom travel points, a corresponding ink volume detector 362, 364 is located to sense the presence of the position indicator 360. In some embodiments only a low ink volume detector 364 is provided to generate a low ink volume signal. The low ink volume signal can be used to initiate a flow of refill ink to the printer cartridge 300. In another embodiment, both high and low ink level detectors 362, 364 are provided to develop signals corresponding to both high and low levels in the expandable ink chamber 315 that can be utilized by the printer for various control functions including the commencement and cessation of the flow of refill ink. Similar to the detectors described above, the high volume detector 362 and low volume detector 364 may be of the light sensing type such as a CCD or a photo-multiplier, they may be a limit switch in a circuit, they may be a magnetic type or they may be any other type of detector commonly used in the art. Some embodiments may utilize detectors that can detect the position of the position indicator 360 at any of the locations along its travel to provide signals that correspond to many possible ink levels of the volume of ink. For instance, the resistance strip 255 illustrated in FIG. 2A may be used in the printer cartridge 300 to indicate a continuum of ink levels as described above. The signals developed by the detectors are then passed on to a processor (not shown) via the electronic leads incorporated onto the: printer cartridge 300 or through independent electronic leads (not shown). The processor may be the printer operating processor, it may be an independent processor, or it may be part of the computer operating the printer. The signals are then utilized by the processor to control the flow of refill ink to the printer cartridge 300. Additionally, because the force applied to expand the ink chamber 315 is determined by the cartridge spring 340, the properties of which are known, the pressure of the ink in the ink chamber 315 is a function of the volume of the ink chamber 315 and the signals generated by the printer cartridge 300 may be used to indicate the pressure of the ink in the printer cartridge 315 as well.

Figure 3B:
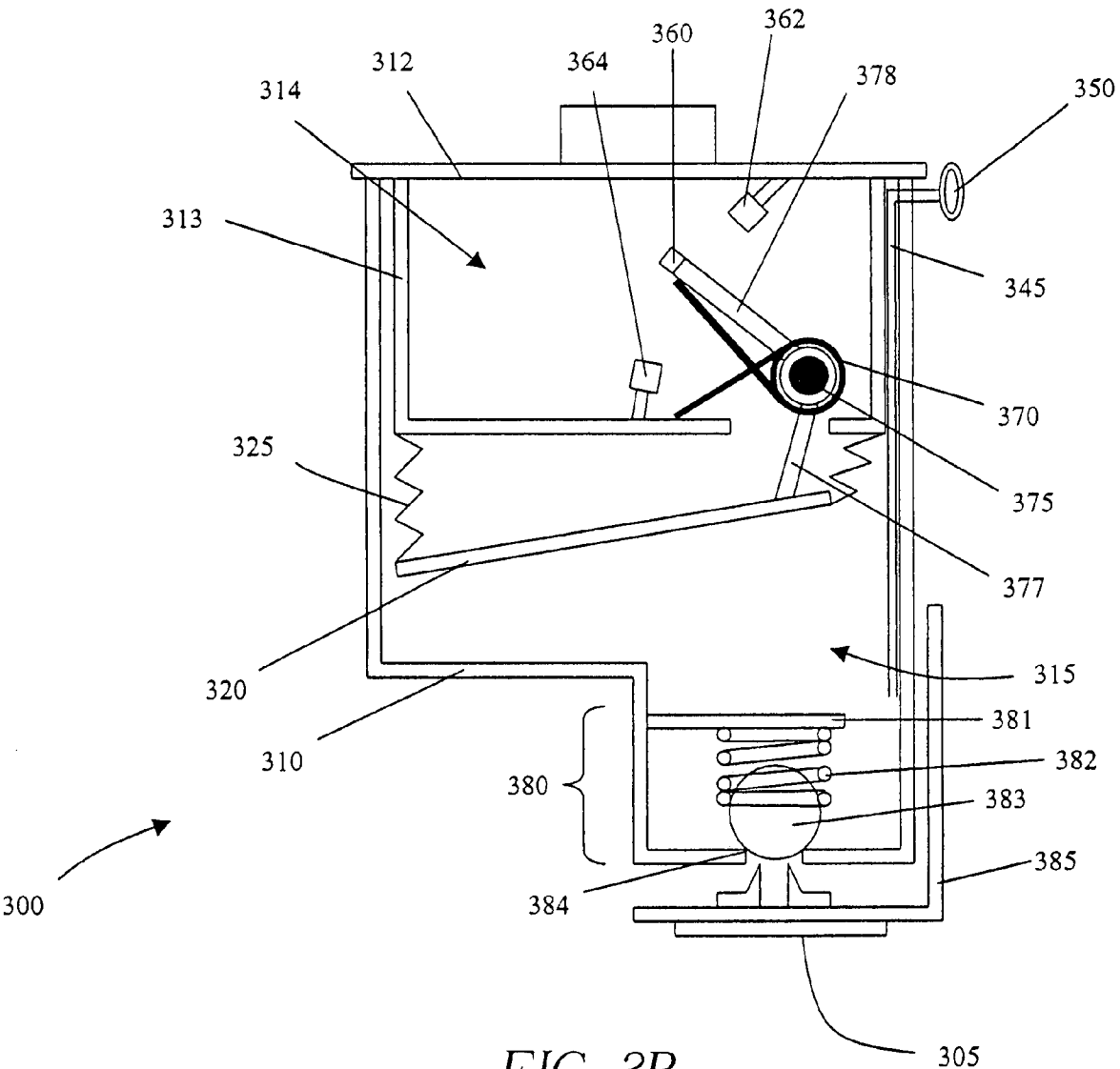
FIG. 3B is a cutaway side view, taken along line 3-3 of FIG. 1, illustrating yet another alternate embodiment of the print cartridge of FIG. 1.

FIG. 3B illustrates an alternate embodiment of a printer cartridge 300 that may be utilized in the system illustrated in FIG. 1. In this embodiment, the nozzle plate 305 is not part of the printer cartridge 300. The printer cartridge 300 instead merely supplies ink to the nozzle plate 305, which is affixed to the printer carriage via a printhead 385. In this embodiment, the printer cartridge 300 has a valve assembly 380 that prevents ink from flowing out of the printer cartridge 300 during handling. A valve plate 381 is firmly attached to an inner wall of the cartridge housing 310 to support the rest of the valve assembly 380. A valve spring 382 rests against the valve plate 381 and exerts a force against a ball 383 that opens and closes the valve assembly 380 to start and stop the flow of ink out of the printer cartridge 300. The ball 383 seats against a valve seat 384, which is a circular hole in the cartridge housing 310 that has a surface shaped to mate evenly and uniformly with the outer surface of the ball 383. The valve spring 382 is compressed between the valve plate 381 and the ball 383 such that it exerts a force on the ball 383 tending to seat the ball against the valve seat 384. In order to commence a flow of ink out of the printer cartridge 300, the force of the valve spring 382 must be overcome to unseat the ball 383. When the printer cartridge 300 is installed onto the carriage, or specifically the printhead 385, the printhead 385 engages with the ball 383, unseating it from the seat 384 and thereby allows a flow of ink from the printer cartridge 300 to be drawn to the nozzle plate 305. The printhead 385 is shaped to mate with and unseat the ball 383 in the valve assembly 380 when the printer cartridge 300 is installed. It is appreciated that the embodiment illustrated in FIG. 3B allows the printer cartridge 300 and the printhead 385 to be replaced independently, further limiting the amount of components to be discarded when either printer cartridge 305 or printhead 385 replacement is required.

Figure 4:
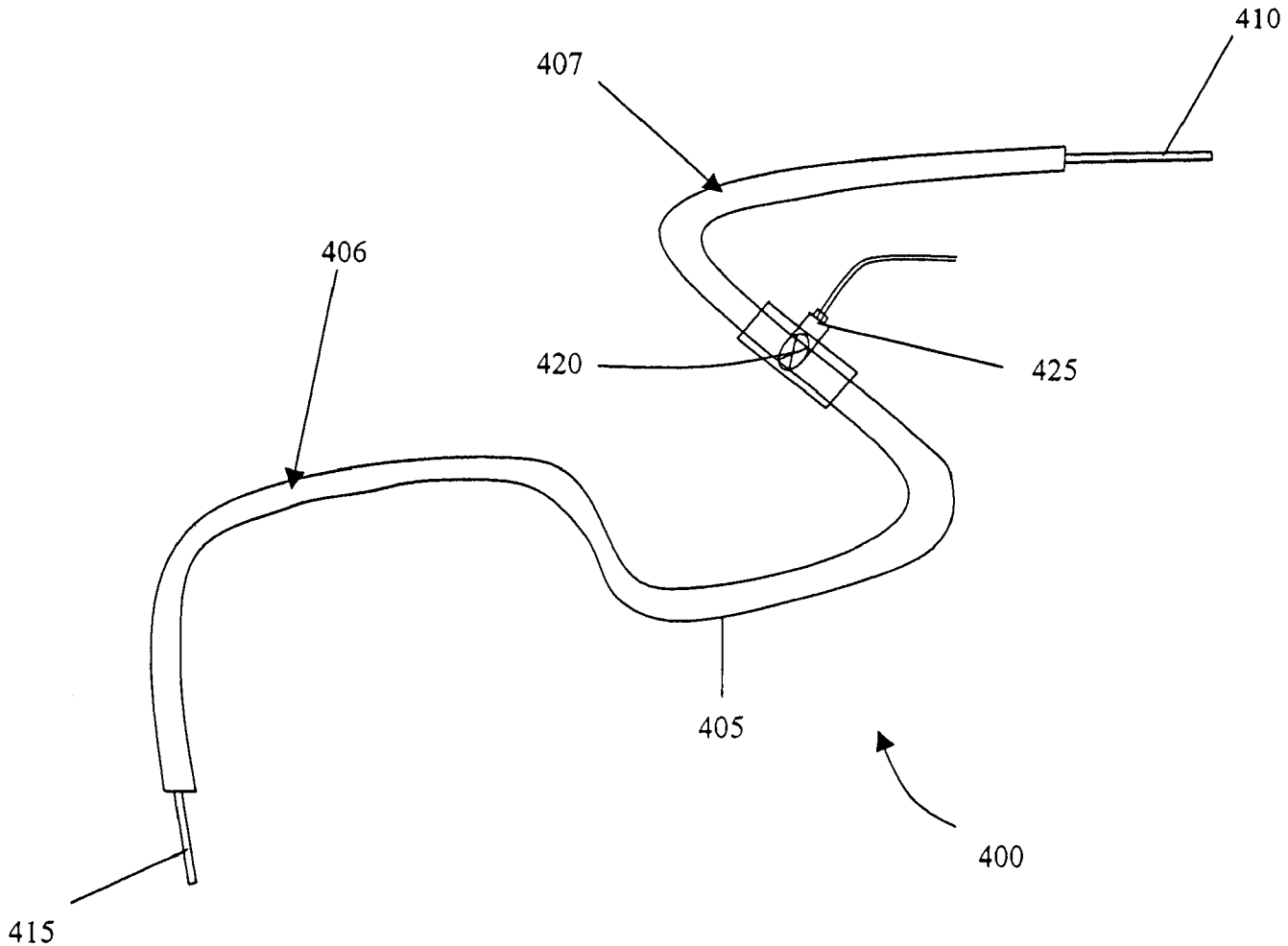
FIG. 4 is a cutaway side view of the ink supply line of FIG. 1.

Referring now to FIG. 4, a cutaway side view of an ink supply line 400 of one embodiment of the system in FIG. 1 is illustrated. FIG. 4 illustrates some of the parts that may be used in various embodiments of the supply line 400. A supply tube 405 is generally a flexible tube having a reservoir end 406 and a cartridge end 407 and is capable of containing ink under pressure and transferring it from the reservoir end 406 to the cartridge end 407. The flexible supply tube 405 is suited to be long enough and flexible enough to create a flowpath from a stationary point where the ink reservoir (item 200 in FIGS. 1 and 2) is located, to the carriage head (not shown), which moves back and forth across the print medium as it deposits ink on the medium. The supply tube 405 may advantageously be of a material light enough to avoid creating unnecessary drag on the print carriage (not shown) as it travels back and forth across the print medium. Referring to FIGS. 3 and 4, the cartridge needle 410 is generally an elongated and narrow tube that is small enough to be inserted into the cartridge septum 350 to allow refill ink to flow from the supply line 400 into the print cartridge 300. The cartridge needle 410 is affixed at one end to the supply tube 405 to contain the ink as it flows from the supply tube 405, while the other end is inserted into the cartridge septum 350 to allow ink to flow into the print cartridge 300. A reservoir needle 415 is affixed to the reservoir end 406 of the supply tube 405. The reservoir needle 415 is generally similar in construction to the cartridge needle 410 and is similarly affixed to the supply tube 405. Referring to FIGS. 2 and 4, the reservoir needle 415 can be inserted into the reservoir septum 230 to form a flowpath that allows ink to pass out of the ink reservoir 200 and into the supply tube 405.

A valve 420 and corresponding valve actuator 425 are installed along the supply tube 405 at a location between the cartridge needle 410 and the reservoir needle 415. The valve 420 is installed in the supply tube in a manner appropriate so that the valve 420 can create and secure a flowpath of ink through the supply tube 405. The valve 420 may be of any type known in the art that can be used to create or secure a flowpath for liquid. These types may include ball valves, gate valves, butterfly valves and needle valves but any type of flow control valve may be utilized. A valve actuator 425 that is attached to the valve housing controls the position of the valve 420. The valve actuator 425 may be any actuator commonly used in the field of valve positioning including, but not limited to, electric actuators, solenoids, hydraulic actuators, pneumatic actuators or manual actuators for operation by the user. In certain embodiments, the valve actuator 425 receives control signals from a processor (not shown) that controls the printer and that is either located in the printer or in a computer or in another device controlling the printer. The processor (not shown) informs the valve actuator 425 when to operate the valve 420. The valve actuator 425 may be capable of positioning the valve 420 in more than just the open or closed position so as to allow a controlled flow rate of the refill ink.

The method of operation can be described by referring to FIGS. 1-4. In particular, the processor (not shown) receives a low ink level signal from the print cartridge level sensing means 360, 362, 364 and responds by developing a control signal that is sent to the valve actuator 425 to position the valve 420 so as to create a flowpath through the supply line 400. The force applied by the reservoir spring 210 to the collapsible ink container 204 creates a pressure inside the collapsible ink container 204 that allows ink to flow out of the reservoir 200 and through the supply line 400 via the supply tube 405 and the valve 420 and into the print cartridge 300. The ink flows into the expandable ink container 315 and expands that container, thereby moving the position indicator 360 away from the low ink level detector 362 and towards the high ink level detector 364. When the level of ink in the expandable ink container 315 reaches a certain level, the high ink level detector 364 senses this condition and develops a corresponding signal that it sends to the printer (not shown). The printer receives the high ink level signal from the high ink level detector 364 and develops a control signal for the valve actuator 425, which, upon receiving the control signal, repositions the valve 420 to secure the flow of refill ink from the reservoir 200 to the print cartridge 300.

Referring again to FIGS. 1-4, in some embodiments, the level detectors 240, 245 for the ink level in the collapsible ink container 204 will develop reservoir ink level signals that will also be sent to the printer for consideration in starting and securing the flow of refill ink. Such signals may prevent the printer from opening the valve to start the flow of refill ink if there is no ink in the reservoir 200 to flow to the print cartridge 300. Many other functions may be performed by the processor or the printer in controlling the flow of ink from the reservoir 200. These may include indicating to the user relevant setpoints of the level of ink in either the reservoir 200 or the print cartridge 300, or analyzing the images that the printer is printing to determine optimum refill timing to maximize printer function and performance. Other advanced control functions may include controlling the flow rate of refill ink through the supply line 400 with the valve 420 so as to minimize pressure fluctuations in the print cartridge 300 during refill operations. Utilizing a processor to control the supply of refill ink, therefore, provides several such advantages over current systems, which utilize mechanical control means for the control of the refill ink supply, many of which must replaced when the cartridge is replaced because they are located in the cartridge.

Figure 4A:
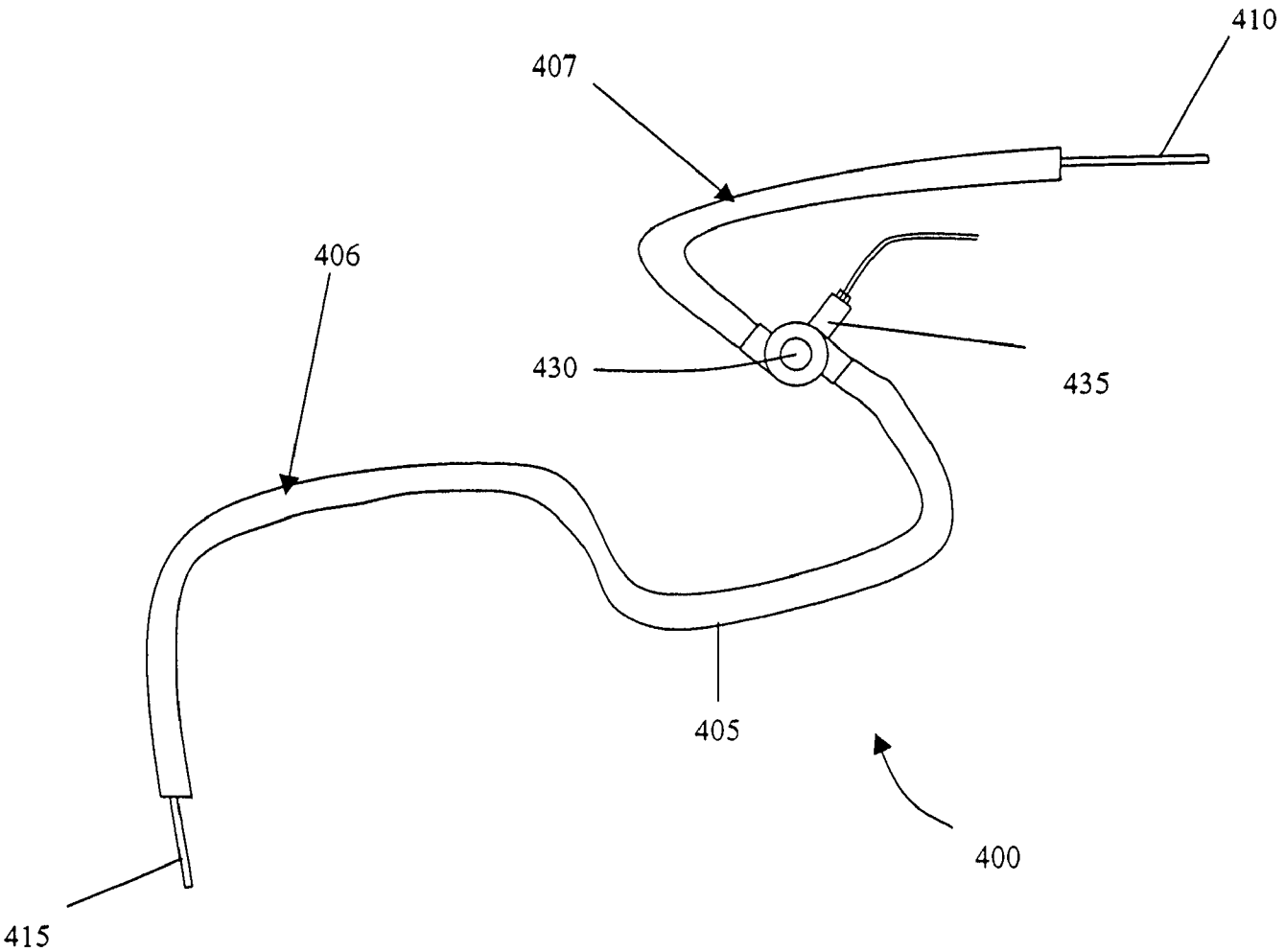
FIG. 4A is a cutaway side view of an alternate embodiment of the ink supply line of FIG. 1.

FIG. 4A illustrates an alternate embodiment of the supply line 400 that utilizes a pump 430. Referring to FIGS. 1-4A, a pump 430 is used to add flow energy to the refill ink and thereby control the flow of refill ink from the reservoir 200 to the printer cartridge 300. This allows the reservoir 300 to be open to atmospheric pressure rather than having to be pressurized and therefore allowing for a simpler construction. The pump 430 is actuated by a pump controller 435 that receives signals from a processor (not shown) in a manner similar to that of the embodiment with a valve 420 described above. The pump used can be any pump known in the field for adding flow energy to a liquid, such as a simple peristaltic pump for example.

By utilizing the embodiment illustrated in FIGS. 4 and 4A, several advantages are achieved. For example, this system may be used to prime the nozzles should they become unprimed, through the supply of pressurized ink to the printer cartridge (item 300 of FIG. 3), whereas past systems could not perform this function. Also, referring to FIGS. 1 and 4A, the use of a pump 430 allows for a simple method of purging the supply line 400 when the user wishes to change ink types. Different ink types are appropriate for different applications and the supply line 400 must be flushed for change over. The use of a pump 430 allows a user to flush the system with the pump 430 rather than having to add some other component to flush the system, or flush the system through the slow siphon of the print nozzles. Additionally, the preferred negative pressure range in the printer cartridge differs for different ink types. By allowing a processor, or the printer controller, or a computer to control the supply of refill ink as a function of the amount of ink in the printer cartridge 300, the proper negative pressure range for various types of inks can be maintained. This is because the negative pressure on the ink in the printer cartridge will vary with the amount of ink in the printer cartridge 300 and the refill process can maintain the level in the proper corresponding levels to correspond to the proper pressure ranges. This cannot be accomplished by other refill systems.

The term processor is used in a general sense and the functions of the processor described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor is suggested by the term processor, but in the alternative, the processor may be any processor, controller, microcontroller, or state machine. A processor may also be implemented as a combination of computing devices, e.g., a combination of a DSP and a microprocessor, a plurality of microprocessors or computers, one or more microprocessors in conjunction with a DSP core, or any other such configuration.

Figure 5:
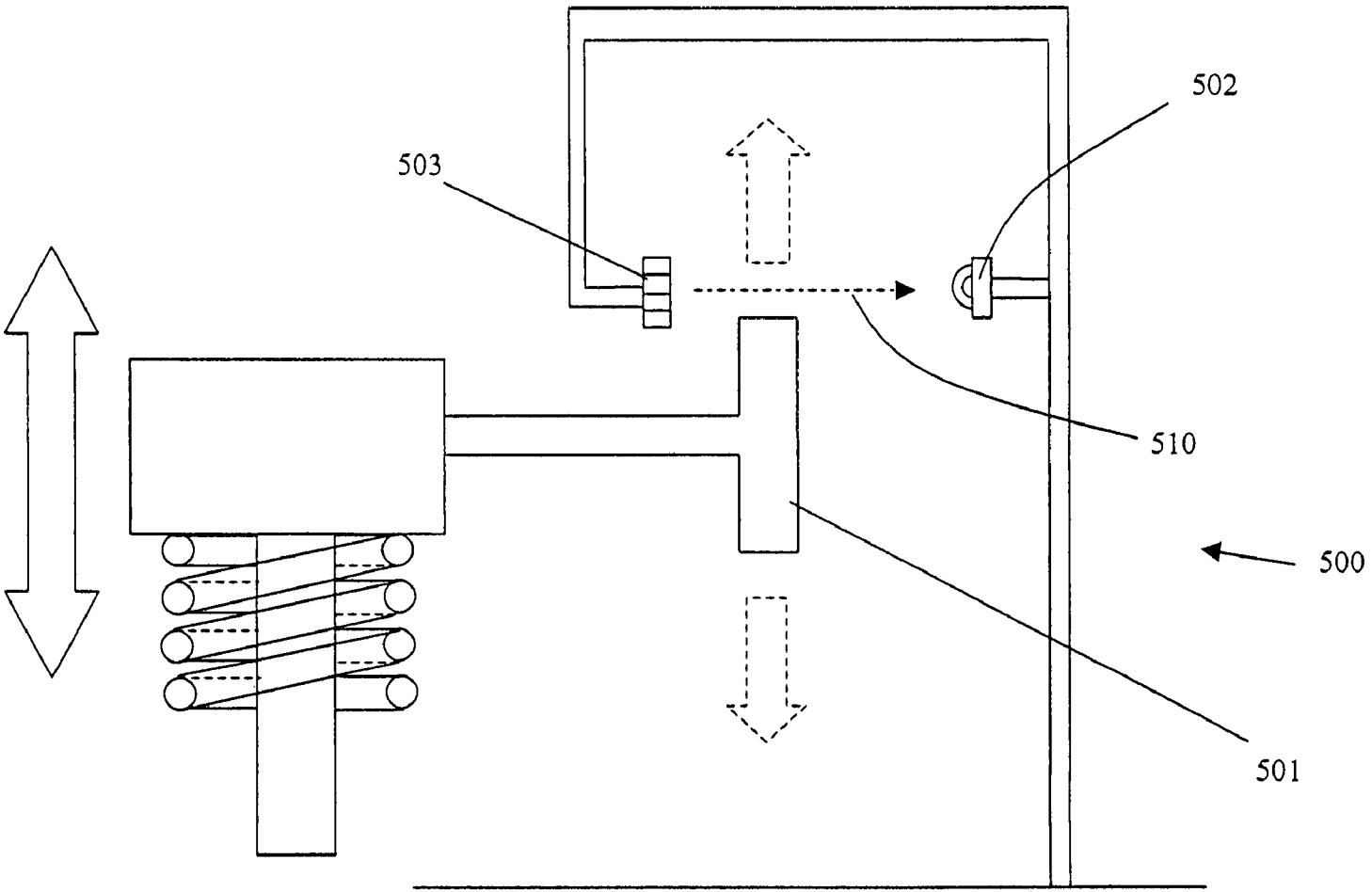
FIG. 5 is a side view of a position indicator, which uses a light source and a light sensor, utilized in the embodiment of the ink reservoir or print cartridge of FIG. 1.

FIG. 5 is a side view of a position detection system 500 of one embodiment that utilizes a light source and a light sensor. Referring to FIGS. 2, 3 and 5, the functions of detecting both a high and a low level setpoint of the travel of either the position indicators 235, 360 may be performed by one position detector 502. FIG. 5, illustrates a simple system for accomplishing this, wherein two positions of a traveling object are detected using one position detector 502. This figure shows a transmitter 503 and a position detector 502 that are relatively aligned so that when there is no interference, the transmitter 503 sends a signal that is received and registered by the position detector 502. The transmitter 503 may transmit light energy, radiowaves, magnetic waves or even particles that can be detected and registered by the position detector 502. The transmission and detection are interfered with by a paddle 501 that travels along a path that is generally orthogonal to the direction of transmission from the transmitter 503 to the position detector 502.

Referring to FIGS. 2, 3 and 5, the paddle 501, when used with the embodiments described above, can move in the vertical direction as do the position indicators 235, 360 illustrated in those figures. When the paddle 501 is at the bottom point of its travel it exposes a transmission path 510 from the transmitter 503 to the position detector 502. As the paddle 501 begins to move up and away from its low travel setpoint, the top of the paddle interferes with the transmission path 510 between the transmitter 503 and the position detector 502, thereby preventing the position detector 502 from receiving the signal transmitted by the transmitter 503. A processor (not shown) in the printer is notified of the discontinued signal, and then determines that the paddle 501 is no longer at the bottom of its travel path. As the paddle 501 continues the travel up to its top travel setpoint, the transmission from the transmitter 503 to the position detector 502 continues to be interfered by the paddle 501. When the paddle 501 reaches its top travel setpoint, the bottom of the paddle 501 exposes the transmission path 510 permitting signal transmission between the transmitter 503 and the position detector 502. The processor (not shown) in the printer is advised of the existence of the signal, and the processor determines that the paddle 501 is at its top travel setpoint. Additionally, the processor may utilize signals from both the reservoir 200 and the printer cartridge 300 to prevent attempting to refill the printer cartridge 300 when the reservoir 200 is empty, thereby preventing the processor from losing track of where the paddle is located in its travel up and down. Alternatively, whenever power is inadvertently lost, the processor may fail to a default setting of the printer cartridge 300 being full so that the refill operation does not inadvertently overfill the printer cartridge 300. By this means, the position of the reservoir plate 220 or the cartridge plate 320, which respectively correspond to the current volume of ink in the ink reservoir 200 and printer cartridge 300, can be determined using one position indicator 501 and one position detector 502 rather than using two detectors to indicate both high and low ink levels in the respective ink containers.

Alternatively, the position detection system 500 may be set up so that only one signal is utilized. In such an embodiment, the position indicator 503 can transmit a signal to the position detector 502 corresponding to either a high travel setpoint or a low travel setpoint of the paddle 501. The position detector 502 then develops a signal to be utilized by the printer corresponding to that setpoint. For instance, the position detection system 500 can be used in the print cartridge (item 300 of FIG. 3) to indicate a low ink level in the printer cartridge (item 300 of FIG. 3). In such a situation, the paddle 501 may be at the bottom travel setpoint exposing the position indicator 503 to the position detector 502. The position detector 502 can then send a signal to the printer (not shown) indicating that the print cartridge (item 300 of FIG. 3) is low on ink. The printer can then commence a refill sequence. As the refill sequence ensues, the paddle 501 would move upward interfering with the transmission between the position indicator 503 and the position detector 502, thereby terminating the signal generated by the position detector 502. The printer may then use either a timing sequence or some other flow control sequence to control the amount of refill ink that is sent to the print cartridge.

Thus, the invention overcomes the problems in the field of printer cartridges by providing an ink cartridge refill system and method that allows continued use of a printer cartridge after its ink has been depleted while maintaining the correct pressure of the ink in the printer cartridge.

The invention has been described in detail with particular reference to certain preferred embodiments thereof, but it will be understood that variations and modifications can be effected within the spirit and scope of the invention.

The invention claimed is:

1. An inkjet printer cartridge comprising:

(a) an ink container including a movable wall portion that allows for an internal volume of the ink container to vary;

(b) a resilient member biasing the movable wall to move to a position that increases the internal volume of the ink container; and (c) an electronic ink level switch system including at least one detector residing within the inkjet printer cartridge responsive to said variable volume, the electronic ink level switch system developing at least one electronic signal that indicates said volume of ink in said expandable ink container.

2. An inkjet printer cartridge as recited in claim 1 wherein: the resilient member is a spring.

3. An inkjet printer cartridge as recited in claim 1 wherein: the level indicator further comprises:

(a) a position indicator that indicates a position of a moveable part of the expandable ink container; and (b) one or more position detectors responsive to the position indicator, and adapted to develop said electronic signal.

4. An inkjet printer cartridge as recited in claim 1 further comprising:

a bellows attached to the movable wall portion.

5. An inkjet printer cartridge as recited in claim 4 further comprising:

a compartment located above the movable portion, the compartment being separated from the ink container by the movable wall, the resilient member residing in the compartment.

6. An inkjet printer cartridge comprising:

(a) an ink container including a movable wall portion that allows for an internal volume of the ink container to vary;

(b) a means for biasing the movable wall to move to a position that increases the internal volume of the ink container; and (c) an electronic ink level switch system including at least one detector residing within the inkjet printer cartridge responsive to said variable volume, the electronic ink level switch system developing at least one electronic signal that indicates said volume of ink in said expandable ink container.

7. An inkjet printer cartridge as recited in claim 6 wherein: the biasing means is a spring.

8. An inkjet printer cartridge as recited in claim 6 further comprising:

a bellows attached to the movable wall portion.

9. An inkjet printer cartridge as recited in claim 8 further comprising:

a compartment located above the movable portion, the compartment being separated from the ink container by the movable wall, the means for biasing residing in the compartment.

10. An inkjet printer cartridge comprising:

(a) an ink container including a movable wall such that the ink container has a variable internal volume, the movable wall being biased to move to a position that increases the internal volume of the ink container; and (b) an electronic ink pressure indicator residing within the inkjet cartridge responsive to the variable internal volume, the electronic ink pressure indicator developing at least one electronic signal that indicates a pressure of the ink in the ink container.

11. An inkjet printer cartridge as recited in claim 10 wherein the pressure indicator further comprises:

(a) a position indicator that indicates a position of a moveable part of the ink container; and (b) one or more position detectors responsive to the position indicator and adapted to develop said electronic signal.

12. An inkjet printer cartridge as recited in claim 10 further comprising:

a means for biasing the movable wall to move to a position that increases the internal volume of the ink container.

13. An inkjet printer cartridge as recited in claim 12 further comprising:

a bellows attached to the movable wall portion.

14. An inkjet printer cartridge as recited in claim 13 further comprising:

a compartment located above the movable portion, the compartment being separated from the ink container by the movable wall and the bellows, the means for biasing residing in the compartment.

15. An inkjet printer cartridge as recited in claim 12 further comprising:

a compartment located above the movable portion, the compartment being separated from the ink container by the movable wall, the means for biasing residing in the compartment.

16. An inkjet printer cartridge as recited in claim 10 further comprising:

a spring member that biases the movable wall to move to a position that increases the internal volume of the ink container.

17. An inkjet printer cartridge as recited in claim 16 further comprising:

a bellows attached to the movable wall portion.

18. An inkjet printer cartridge as recited in claim 16 further comprising:

a compartment located above the movable portion, the compartment being separated from the ink container by the movable wall, the means for biasing residing in the compartment.

19. An inkjet printer cartridge as recited in claim 16 further comprising:

a compartment located above the movable portion, the compartment being separated from the ink container by the movable wall and the bellows, the means for biasing residing in the compartment.

* * * * *